US010934853B2

(12) United States Patent
Shi et al.

(10) Patent No.: US 10,934,853 B2
(45) Date of Patent: Mar. 2, 2021

(54) DAMAGE TOLERANT COOLING OF HIGH TEMPERATURE MECHANICAL SYSTEM COMPONENT INCLUDING A COATING

(71) Applicant: Rolls-Royce Corporation, Indianapolis, IN (US)

(72) Inventors: Jun Shi, Carmel, IN (US); Kang N. Lee, Zionsville, IN (US); Ann Bolcavage, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 631 days.

(21) Appl. No.: 14/788,005

(22) Filed: Jun. 30, 2015

(65) Prior Publication Data

US 2016/0003052 A1 Jan. 7, 2016

Related U.S. Application Data

(60) Provisional application No. 62/020,532, filed on Jul. 3, 2014.

(51) Int. Cl.

| | |
|---|---|
| ***F01D 5/18*** | (2006.01) |
| ***F23R 3/00*** | (2006.01) |
| ***C23C 4/12*** | (2016.01) |
| ***C23C 4/134*** | (2016.01) |
| ***C23C 30/00*** | (2006.01) |
| ***F01D 5/28*** | (2006.01) |
| *F01D 25/12* | (2006.01) |

(52) U.S. Cl.

CPC ..... *F01D 5/186* (2013.01); *C23C 4/134* (2016.01); *C23C 30/00* (2013.01); *F01D 5/288* (2013.01); *F01D 25/12* (2013.01); *F05D 2230/90* (2013.01); *F05D 2260/202* (2013.01); *F05D 2300/611* (2013.01); *F23R 2900/03041* (2013.01); *F23R 2900/03042* (2013.01)

(58) Field of Classification Search

CPC . F01D 5/046; F01D 5/08; F01D 5/186; F01D 25/12

See application file for complete search history.

(56) References Cited

U.S. PATENT DOCUMENTS 3,606,572 A * 9/1971 Schwedland ..... F01D 5/184 29/889.721
5,683,825 A 11/1997 Bruce et al.
5,771,577 A 6/1998 Gupta et al.
(Continued)

*Primary Examiner* — David Hamaoui
*Assistant Examiner* — Brian O Peters
(74) *Attorney, Agent, or Firm* — Shumaker & Sieffert, P.A.

(57) ABSTRACT

An article may include a substrate, a plurality of cooling holes in the substrate, wherein each of the plurality of cooling holes defines substantially the same diameter measured parallel to an outer surface of the substrate, and a coating on the surface of the substrate. In accordance with these examples, the coating covers and substantially blocks a first set of cooling holes from the plurality of cooling holes and leaves a second set of cooling holes from the plurality of cooling holes substantially uncovered. In some examples, an article including a substrate, a plurality of cooling holes in the substrate, and a coating on the substrate. In accordance with these examples, the coating covers and partially occludes each cooling hole of the plurality of cooling holes, and the coating does not extend into any of the plurality of cooling holes.

6 Claims, 8 Drawing Sheets

(56) References Cited

U.S. PATENT DOCUMENTS

| | | | | |
|---|---|---|---|---|
| 5,993,976 | A | 11/1999 | Sahoo et al. | |
| 6,033,619 | A * | 3/2000 | Hattori | B28B 1/002 264/629 |
| 6,039,537 | A * | 3/2000 | Scheurlen | F01D 5/186 415/115 |
| 6,408,610 | B1 | 6/2002 | Caldwell et al. | |
| 6,655,146 | B2 | 12/2003 | Kutter et al. | |
| 6,667,076 | B2 | 12/2003 | Fried et al. | |
| 6,761,956 | B2 | 7/2004 | Lee et al. | |
| 7,186,091 | B2 | 3/2007 | Lee et al. | |
| 7,216,485 | B2 | 5/2007 | Caldwell et al. | |
| 7,241,107 | B2 * | 7/2007 | Spanks, Jr. | F01D 5/186 29/889.721 |
| 7,666,528 | B2 | 2/2010 | Hazel et al. | |
| 7,669,422 | B2 | 3/2010 | Suleiman et al. | |
| 7,805,822 | B2 | 10/2010 | Hanley | |
| 7,900,458 | B2 | 3/2011 | James et al. | |
| 7,909,581 | B2 * | 3/2011 | Klein | C23C 14/042 416/241 B |
| 8,052,378 | B2 * | 11/2011 | Draper | F01D 5/186 415/115 |
| 2006/0016191 | A1 | 1/2006 | Woodcock et al. | |
| 2010/0247323 | A1 | 9/2010 | Persky et al. | |
| 2012/0163984 | A1 * | 6/2012 | Bunker | F01D 5/187 416/241 B |

* cited by examiner

DAMAGE TOLERANT COOLING OF HIGH TEMPERATURE MECHANICAL SYSTEM COMPONENT INCLUDING A COATING

RELATED APPLICATIONS

This application claims the benefit of U.S. Provisional Application No. 62/020,532, titled, "DAMAGE TOLERANT COOLING OF HIGH TEMPERATURE MECHANICAL SYSTEM COMPONENT INCLUDING A COATING," filed Jul. 3, 2014, the entire content of which is incorporated herein by reference.

TECHNICAL FIELD

The disclosure relates to coated components including cooling holes.

BACKGROUND

Components in a gas turbine engine are often cooled to survive the high temperatures found therein. For example, thin film cooling supplies air, used as a cooling fluid, to a passage within the component, exiting via film cooling holes to form a thin film over the external surface of the component. In addition to removing heat from the component by conduction, the thin film of cooling air serves to prevent hot gas within the gas turbine engine from impinging upon the component. The cooling air used for thin film cooling must be supplied at a pressure greater than the gas path pressure in which the component is operating to cause flow of cooling air through the passage in the component and out of the cooling holes. This requires work to be carried out on the cooling air, representing a loss of useful power from the engine.

Many components in gas turbine engines also include coatings, such as thermal barrier coatings (TBCs) or environmental barrier coatings (EBCs) that provide protection to the substrate from hot gases within the gas turbine engine.

SUMMARY

The disclosure describes a damage-tolerant cooling mechanism for an article of a high temperature mechanical system and techniques for forming the article including the damage-tolerant cooling mechanism. In some examples, the article may include a plurality of film cooling holes formed in a substrate of the article. The component also may include a coating on the substrate. The coating may include, for example, a thermal barrier coating layer (TBC), an environmental barrier coating layer (EBC), or both. In some examples, the coating may cover and substantially block some of the plurality of cooling holes. In this way, the coating may reduce a number of cooling holes through which cooling fluid may flow and exit to form a film on the outer surface of the component.

However, if a portion of the coating is damaged and spalls, additional cooling holes may be exposed, allowing cooling fluid to flow through the exposed cooling holes and over the surface of the component proximate to the exposed cooling holes. Although the additional exposed cooling holes may reduce efficiency of the high temperature mechanical system, the additional cooling may reduce or substantially prevent further damage to the component until the coating can be repaired.

In some examples, the disclosure also describes a technique for forming an article including a damage resistant cooling mechanism. The technique may facilitate formation of a coating that partially occludes at least some cooling holes of a plurality of cooling holes formed in a substrate of the article. The technique may include forming a plurality of cooling holes in a substrate, followed by applying a material to at least partially fill the plurality of cooling holes. The technique also may include polishing the surface of the substrate so the surface is uncovered of the material in the cooling holes. A coating is then formed on the surface of the substrate and the at least partially filled plurality of cooling holes. A plurality of holes then may be formed in the coating at locations corresponding to the plurality of cooling holes. In some examples, the plurality of holes each defines a diameter that is less than the diameter of each of the cooling holes.

In some examples, the disclosure describes an article including a substrate, a plurality of cooling holes in the substrate, wherein each of the plurality of cooling holes defines substantially the same diameter measured parallel to an outer surface of the substrate, and a coating on the surface of the substrate. In accordance with these examples, the coating covers and substantially blocks a first set of cooling holes from the plurality of cooling holes and leaves a second set of cooling holes from the plurality of cooling holes substantially uncovered.

In some examples, the disclosure describes an article including a substrate, a plurality of cooling holes in the substrate, and a coating on the substrate. In accordance with these examples, the coating covers and partially occludes each cooling hole of the plurality of cooling holes, and the coating does not extend into any of the plurality of cooling holes.

In some examples, the disclosure describes a method including forming a plurality of cooling holes in a substrate. In accordance with these examples, each cooling hole of the plurality of cooling holes defines a diameter D1 measured parallel to a surface of the substrate. The method also may include applying a material to occlude the plurality of cooling holes while leaving the surface of the substrate substantially uncovered, forming a coating on the surface of the substrate and a surface of the material, and forming a hole in the coating at each of a plurality of respective locations corresponding to respective locations of the plurality of cooling holes.

The details of one or more examples are set forth in the accompanying drawings and the description below. Other features, objects, and advantages will be apparent from the description and drawings, and from the claims.

DETAILED DESCRIPTION

Figure 1A:
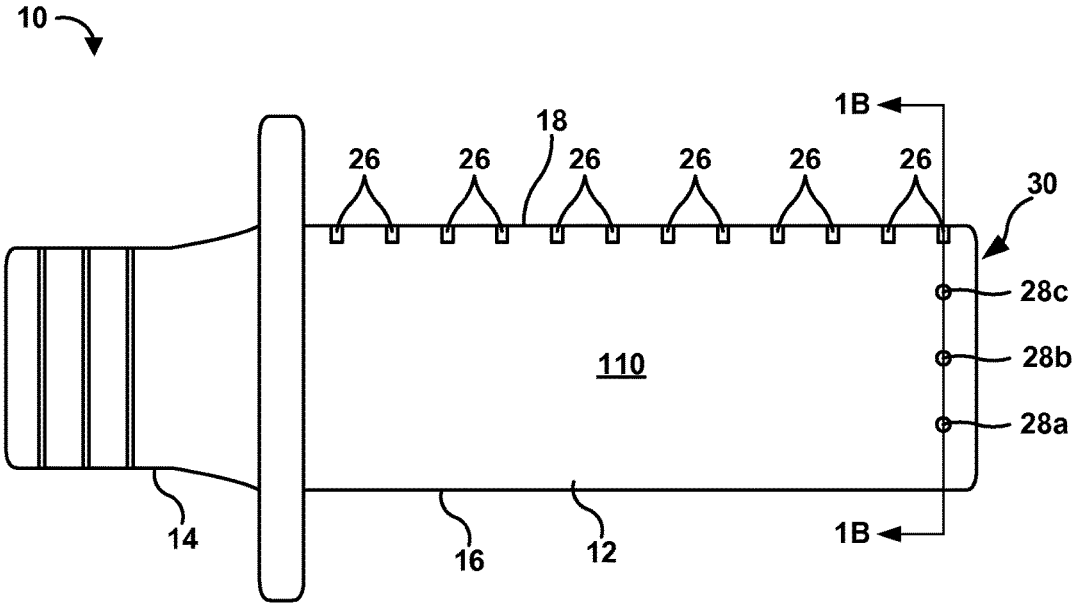
FIGS. 1A and 1B are conceptual and schematic diagrams illustrating an example article including a damage tolerant cooling mechanism.

The disclosure describes a damage-tolerant cooling mechanism for an article of a high temperature mechanical system and techniques for forming the article including the damage-tolerant cooling mechanism. In some examples, the article may include a plurality of film cooling holes formed in a substrate of the article. In some examples, each of the plurality of cooling holes may define a diameter (measured parallel to the surface of the substrate) that is substantially the same (e.g., the same or nearly the same). The component also may include a coating on the substrate. The coating may include, for example, a thermal barrier coating layer (TBC), an environmental barrier coating layer (EBC), or both. The coating may cover and substantially block some of the plurality of cooling holes. In this way, the coating may reduce a number of cooling holes through which cooling fluid may flow and exit to form a film on the outer surface of the component. This may be beneficial, as excess cooling fluid may reduce an efficiency of the high temperature mechanical system.

However, if a portion of the coating is damaged and spalls, additional cooling holes may be exposed, allowing cooling fluid to flow through the exposed cooling holes and over the surface of the component proximate to the exposed cooling holes. This may help reduce surface temperatures of the component proximate to the exposed cooling holes, which no longer have a TBC or EBC for protection. Although the additional exposed cooling holes may reduce efficiency of the high temperature mechanical system, the additional cooling may reduce or substantially prevent further damage to the component until the coating can be repaired.

In some examples, the substrate of the component may be susceptible to chemical attack from species present in the atmosphere adjacent to the component. For example, a substrate including a ceramic or ceramic matrix composite (CMC) may be susceptible to attack by water vapor, which volatizes silicon in the ceramic or CMC. The additional cooling fluid flowing over the surface of the substrate may also reduce or substantially prevent attack of the substrate by environmental species, such as water vapor.

In some examples, the disclosure also describes a technique for forming an article including a damage resistant cooling mechanism. The technique may facilitate formation of a coating that partially occludes at least some cooling holes of a plurality of cooling holes formed in a substrate of the article. In this way, the coating may allow a first, smaller amount of cooling fluid through the cooling holes when the coating is intact. However, when a portion of the coating is damaged, removing a portion of the coating that previously occluded a cooling hole, an increased amount of cooling fluid may pass through the cooling hole. This may increase the flow of cooling fluid over the substrate adjacent to the open cooling hole, where the coating is damaged. This may help reduce surface temperatures of the component proximate to the exposed cooling holes, which no longer have a TBC or EBC for protection. Although the additional exposed cooling holes may reduce efficiency of the high temperature mechanical system, the additional cooling may reduce or substantially prevent further damage to the component until the TBC or EBC can be repaired.

The technique may include forming a plurality of cooling holes in a substrate, followed by applying a material to at least partially fill the plurality of cooling holes. The technique also may include polishing the surface of the substrate so the surface is uncovered of the material in the cooling holes. A coating is then formed on the surface of the substrate and the at least partially filled plurality of cooling holes. A plurality of holes then may be formed in the coating at locations corresponding to the plurality of cooling holes. In some examples, the plurality of holes each defines a diameter that is less than the diameter of each of the cooling holes. In some examples, the material then may be removed from the cooling holes, e.g., using a high temperature heat treatment.

Figure 1B:
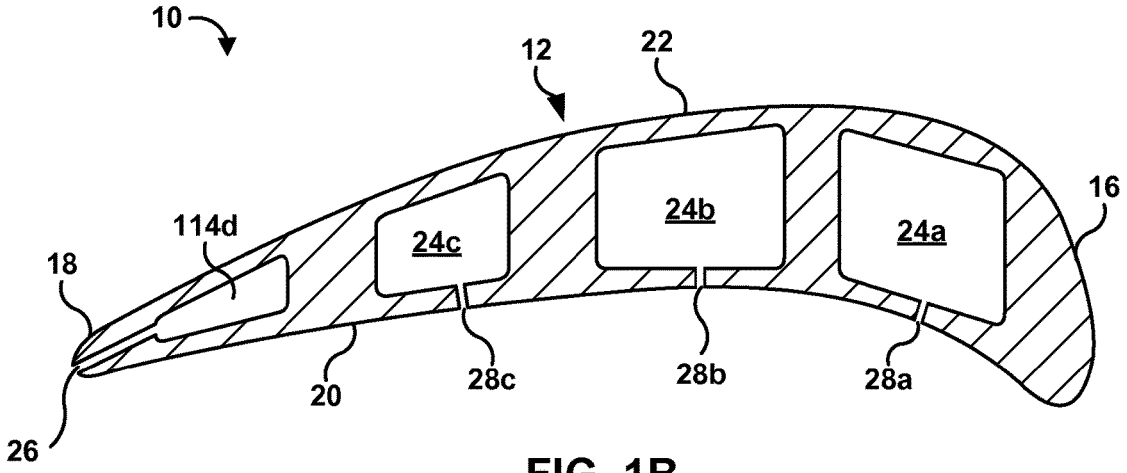

FIGS. 1A and 1B are conceptual and schematic diagrams illustrating an example article including a damage tolerant cooling mechanism. In the example of FIGS. 1A and 1B, the article includes a gas turbine engine blade 10. In other examples, the article may include another component of a high temperature mechanical system, such as another component of a gas turbine engine. For example, the article may include a gas turbine engine vane, combustor liner, or the like.

FIGS. 1A and 1B illustrate two views of turbine blade 10. Turbine blade 10 generally includes an airfoil 12 attached to a stalk 14. Airfoil 12 includes a leading edge 16, a trailing edge 18, a pressure sidewall 20 and a suction sidewall 22. Pressure sidewall 20 is connected to suction sidewall 22 at trailing edge 18 and leading edge 16.

In example illustrated in FIGS. 1A and 1B, turbine blade 10 also includes a first cavity 24*a*, second cavity 24*b*, third cavity 24*c*, and fourth cavity 24*d* (collectively "cavities 24"). Cavities 24 may aid in cooling turbine blade 10 during operation of blade 10 by circulating relatively cool air through the interior of turbine blade 10. In some examples, one or more of cavities 24 is in fluid communication with at least another one of cavities 24. Blade 10 may include more than four cavities 24 or fewer than four cavities 24.

Turbine blade 10, and more specifically airfoil 12, may also include a plurality of cooling holes. The cooling holes may include trailing edge exit slots 26. As is best seen in FIG. 1B, at least one of trailing edge exit slots 26 is fluidly connected to fourth cavity 24*d*. Trailing edge exit slots 26 provide an exit for the relatively cool air that flows through fourth cavity 24*d*. The plurality of cooling holes also includes film cooling holes 28. Film cooling holes 28 are in fluid communication with respective ones of cavities 24. Film cooling holes 28 may be located proximate to tip 30 of blade 10, as shown in FIG. 1A. In other examples, film cooling holes 28 may be arrayed along at least a portion of the length of airfoil 12, e.g., on pressure sidewall 20, suction sidewall 22, or both. Airfoil 12 may include more than three film cooling holes 28, e.g., a plurality of film cooling holes 28. In some examples, tip 30 of blade 10 also may include film cooling holes 28.

Turbine blade 10 may include a damage tolerant cooling mechanism, which may include a coating formed on turbine blade 10. In some examples, the coating occludes some of the cooling holes (e.g., some of film cooling holes 28, some of trailing edge exit slots 26, or both) while leaving other cooling holes uncovered. In other examples, the coating partially occludes at least some of the cooling holes. Regardless, the coating may reduce an amount of cooling fluid that flows through the cooling holes when the coating is intact (e.g., in an undamaged state). However, if a portion of the coating is damaged and spalls from turbine blade 10, additional cooling holes may be uncovered or a greater extent of a cooling hole may be uncovered. This may result in greater cooling fluid flow over turbine blade 10 adjacent to the damaged portion of the coating, which may improve cooling of the turbine blade 10 at that location. Additionally, the increased cooling fluid flow may reduce exposure of the substrate of turbine blade 10 to gases in the environment of the gas turbine engine, which may reduce chemical attack on the exposed substrate.

Figure 2A:
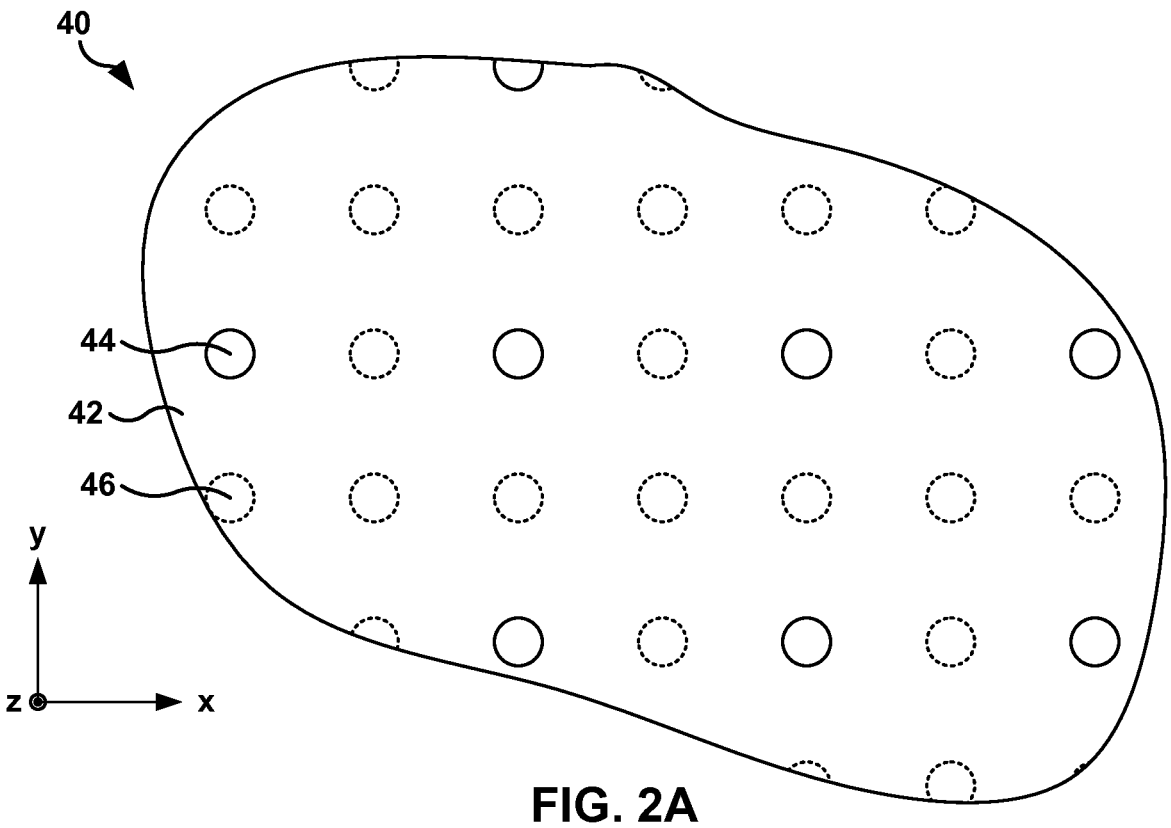
FIGS. 2A-2C are conceptual and schematic diagrams illustrating an example substrate including a plurality of cooling holes, some of which are covered by a coating.
Figure 2B:
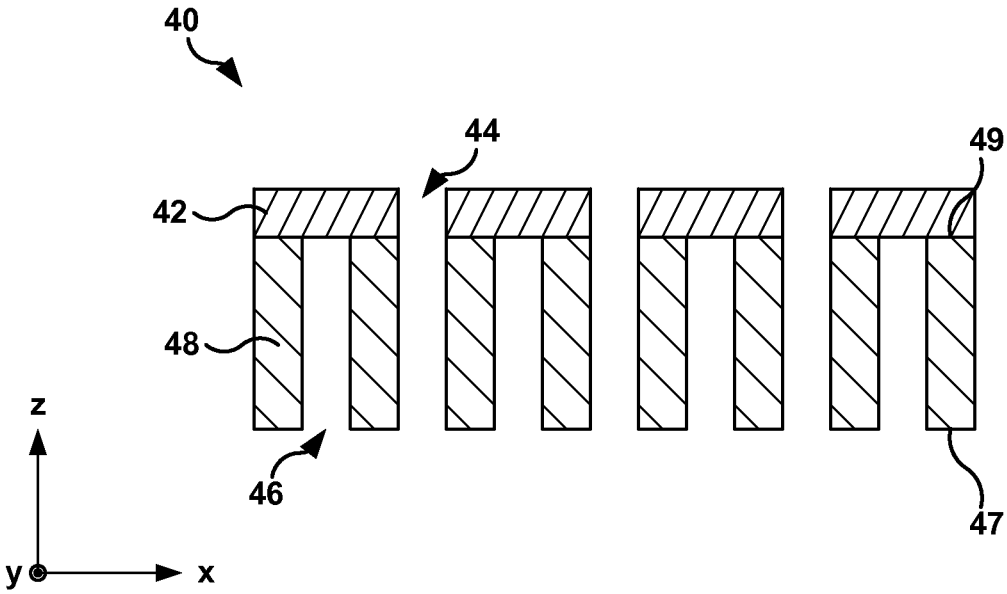
Figure 2C:
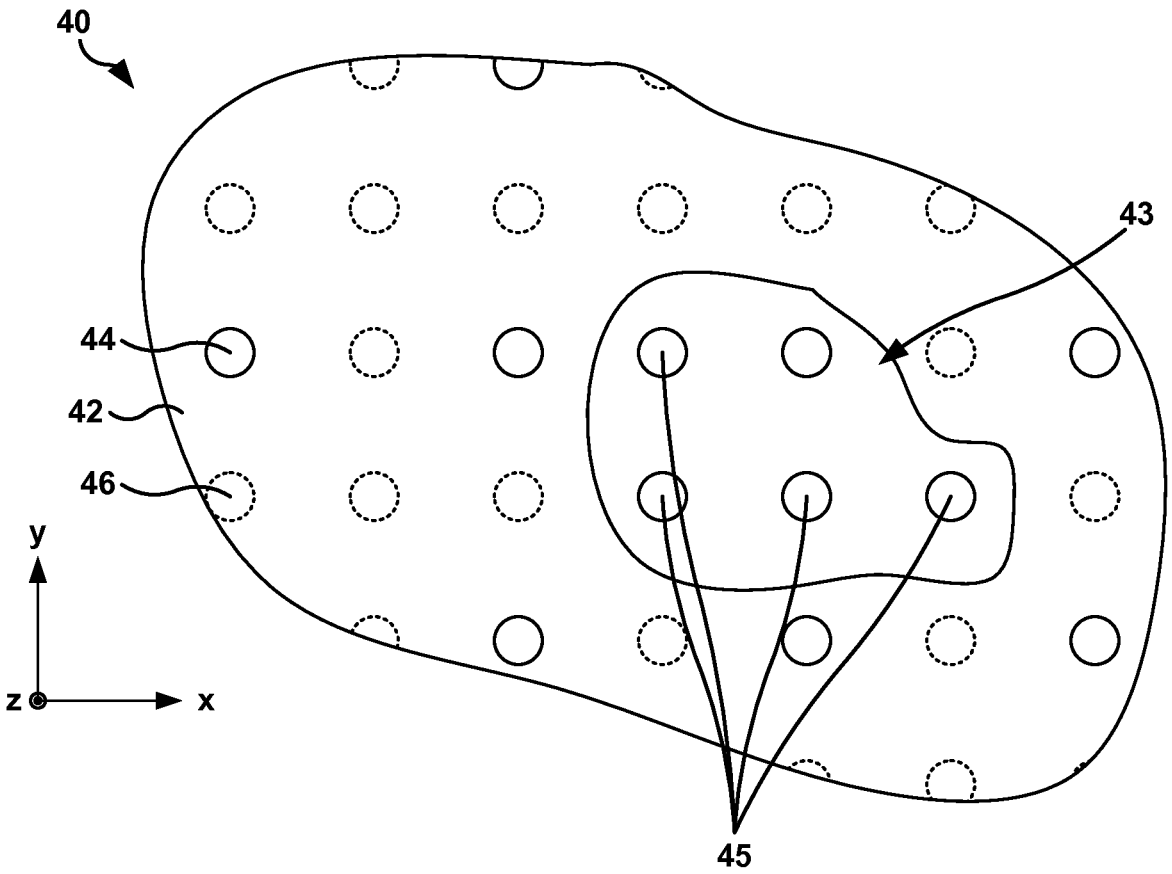

FIGS. 2A-2C are conceptual and schematic diagrams illustrating an example article 40 including a plurality of cooling holes 44 and 46 in a substrate 48, some of which are covered by a coating. In some examples, article 40 is a turbine blade 10. In other examples, article 40 may be another component of a high temperature mechanical system, such as a gas turbine engine.

Article 40 includes substrate 48, coating 42, first plurality of cooling holes 44, and second plurality of cooling holes 46. Substrate 48 may include a superalloy, a ceramic, a ceramic matrix composite (CMC), or a metal alloy that includes silicon. In examples in which substrate 48 includes a ceramic, the ceramic may be substantially homogeneous. In some examples, a substrate 48 that includes a ceramic includes, for example, a Si-containing ceramic, such $SiO_2$, silicon carbide (SiC) or silicon nitride ($Si_3N_4$); $Al_2O_3$; aluminosilicate (e.g., $Al_2SiO_5$); or the like. In other examples, substrate 48 includes a metal alloy that includes Si, such as a molybdenum-silicon alloy (e.g., $MoSi_2$) or a niobium-silicon alloy (e.g., $NbSi_2$).

In examples in which substrate 48 includes a CMC, substrate 48 includes a matrix material and a reinforcement material. The matrix material includes a ceramic material, such as, for example, SiC, $Si_3N_4$, $Al_2O_3$, aluminosilicate, $SiO_2$, or the like. The CMC further includes a continuous or discontinuous reinforcement material. For example, the reinforcement material may include discontinuous whiskers, platelets, or particulates. As other examples, the reinforcement material may include a continuous monofilament or multifilament weave.

In examples in which substrate 48 includes a superalloy, substrate 48 may include a Ni-, Co-, Ti-based superalloy, or the like. Substrate 48 including a superalloy may include other additive elements to alter its mechanical properties, such as toughness, hardness, temperature stability, corrosion resistance, oxidation resistance, and the like, as is well known in the art. Any useful superalloy may be utilized in substrate 48, including, for example, those available from Martin-Marietta Corp., Bethesda, Md., under the trade designation MAR-M247; those available from Cannon-Muskegon Corp., Muskegon, Mich., under the trade designations CMSX-4 and CMSX-10; and the like.

Coating 42 may include a thermal barrier coating (TBC), an environmental barrier coating (EBC), or both. A TBC may provide temperature resistance (i.e., thermal insulation) to substrate 48, so the temperature experienced by substrate 48 is lower than when substrate 48 is not coated with coating 42. In other examples, such as when substrate 48 includes a ceramic or CMC, coating 42 may include an EBC or an EBC/TBC bilayer or multilayer coating to provide resistance to oxidation, water vapor attack, or the like, in addition to temperature resistance.

Some TBCs include ceramic layers comprising zirconia or hafnia. The zirconia or hafnia TBC optionally may include one or more other elements or compounds to modify a desired characteristic of the TBC, such as, for example, phase stability, thermal conductivity, or the like. Exemplary additive elements or compounds include rare earth oxides (oxides of Lu, Yb, Tm, Er, Ho, Dy, Tb, Gd, Eu, Sm, Pm, Nd, Pr, Ce, La, Y, or Sc). In some examples, a TBC may include hafnia and/or zirconia, a primary dopant, a first co-dopant, and a second co-dopant. The primary dopant may be present in the TBC in a greater amount than either the first or second co-dopants, and may be present in an amount less than, equal to, or greater than the total amount of the first and second co-dopants. The primary dopant may include ytterbia, the first co-dopant may include samaria, and the second co-dopant may include at least one of lutetia, scandia, ceria, gadolinia, neodymia, or europia. Other TBCs may include other compositions.

An EBC reduces or prevents attack of the substrate 48 by chemical species present in the environment in which article 40 is utilized, e.g., in the hot section of a gas turbine engine. For example, the EBC may include a material that is resistant to oxidation or water vapor attack. Examples of EBC materials include mullite; glass ceramics such as barium strontium aluminosilicate ($BaO—SrO—Al_2O_3$-$2SiO_2$; BSAS), calcium aluminosilicate ($CaAl_2Si_2O_8$; CAS), cordierite (magnesium aluminosilicate), and lithium aluminosilicate; and rare earth silicates (silicates of Lu, Yb, Tm, Er, Ho, Dy, Tb, Gd, Eu, Sm, Pm, Nd, Pr, Ce, La, Y, or Sc). The rare earth silicate may be a rare earth mono-silicate ($RE_2SiO_5$, where RE stands for "rare earth") or a rare earth di-silicate ($RE_2Si_2O_7$, where RE stands for "rare earth"). In some examples, coating 42 that includes an EBC is deposited as a substantially non-porous layer, while in other examples, coating 42 is deposited as a layer that includes a plurality of cracks.

Substrate 48 defines a plurality of cooling holes 44 and 46. The plurality of cooling holes 44 and 46 may include film cooling holes 28 (FIGS. 1A and 1B), trailing edge exit slots 26 (FIGS. 1A and 1B), or both. The plurality of cooling holes 44 and 46 extend from an inner surface 47 of substrate 48 to an outer surface 49 of substrate. Although not shown in FIGS. 2A-2C, inner surface 47 of substrate 48 may define an internal cavity through which cooling fluid flows (e.g., internal cavities 24 illustrated in FIG. 1B). Additionally or alternatively, although cooling holes 44 and 46 are illustrated as extending substantially normal to outer surface 49 of substrate 48, in some examples, at least some of cooling holes 44 and 46 may extend at an oblique angle with respect to outer surface 49.

Cooling holes 44 and 46 may be arrayed throughout substrate in one or more predetermined patterns. The one or more predetermined patterns may be determined based on a predicted thermal stress experienced at the respective locations of the one or more predetermined patterns during use of article 40. For example, article 40 may be a gas turbine engine blade, and a first location of the blade may be predicted to experience higher temperatures than a second location of the blade. Accordingly, in this example, the first pattern of cooling holes 44 and 46 at the first location may have a greater surface density (e.g., cooling holes per unit area) than the second pattern of cooling holes 44 and 46 at the second location. Other examples are also contemplated and within the scope of this disclosure.

Cooling holes 44 and 46 may define a diameter between about 0.015 inch (about 0.381 millimeters) and about 0.030 inch (about 0.762 millimeters). In some examples, a spacing between adjacent cooling holes of first plurality of cooling holes 44 may be between about 3 and about 6 times the diameter of cooling holes of first plurality of cooling holes 44.

Cooling holes in first plurality of cooling holes 44 may be interleaved with cooling holes in second plurality of cooling holes 46. In some examples, as shown in FIG. 2A-2C, first plurality of cooling holes 44 are arrayed in a first grid configuration and second plurality of cooling holes 46 are arrayed in a second grid configuration. The first and second grid configurations may be interleaved, producing the arrangement shown in FIGS. 2A-2C. In other examples, first plurality of cooling holes 44 and second plurality of cooling holes 46 may be arrayed in a different pattern, such as concentric geometric patterns (e.g., circular or polygonal patterns). Cooling holes from first plurality of cooling holes 44 may be interspersed between cooling holes of second plurality of cooling holes 46.

In some examples, article 40 may include at least one of second plurality of cooling holes 46 for each cooling hole in first plurality of cooling holes 44. For example, article 40 may include at least two of second plurality of cooling holes 46 for each cooling hole in first plurality of cooling holes 44. In the example illustrated in FIGS. 2A-2C, article 40 may include at three cooling holes of second plurality of cooling holes 46 for each cooling hole in first plurality of cooling holes 44.

As shown in FIGS. 2A and 2B, coating 42 is formed on a surface 49 of substrate 48. Coating 42 leaves a first set of cooling holes 44 substantially uncovered and substantially covers a second set of cooling holes 46. In this way, coating 42 occludes second set of cooling holes 46, substantially blocking flow of cooling fluid through second set of cooling holes 46 and out over the surface of coating 42 when coating 42 is intact (e.g., not damaged).

However, if a portion 43 of coating 42 is damaged, as shown in FIG. 2C, a corresponding portion of substrate 48 may be exposed. Additionally, the cooling holes 45 of second set of cooling holes 46 that were covered by portion 43 of coating 42 may be exposed. These cooling holes 45 then may allow cooling fluid to flow from the internal cavities of article 40 (e.g., internal cavities 24 illustrated in FIG. 1B) through the cooling holes 45 and over the exposed portion of substrate 48 that was previously covered by coating 42. Because the cooling holes in second set of cooling holes 46 have the same diameter as the cooling holes in first set of cooling holes 44, once cooling holes 45 are exposed, substantially the same amount cooling fluid may flow through each of cooling holes 45 as through each of the cooling holes in first set of cooling holes 44. This may result in desirable cooling of the portion of substrate 48 exposed when portion 43 of coating 42 spalls.

Although the additional cooling fluid flowing through exposed cooling holes 45 and over substrate 48 may reduce efficiency of the gas turbine engine, the additional cooling may reduce or substantially prevent further damage to the article 40 (including substrate 48) until the coating 42 can be repaired. In this way, article 40, including first set of cooling holes 44, second set of cooling holes 46, and coating 42 may include a damage tolerant cooling mechanism.

Figure 3A:
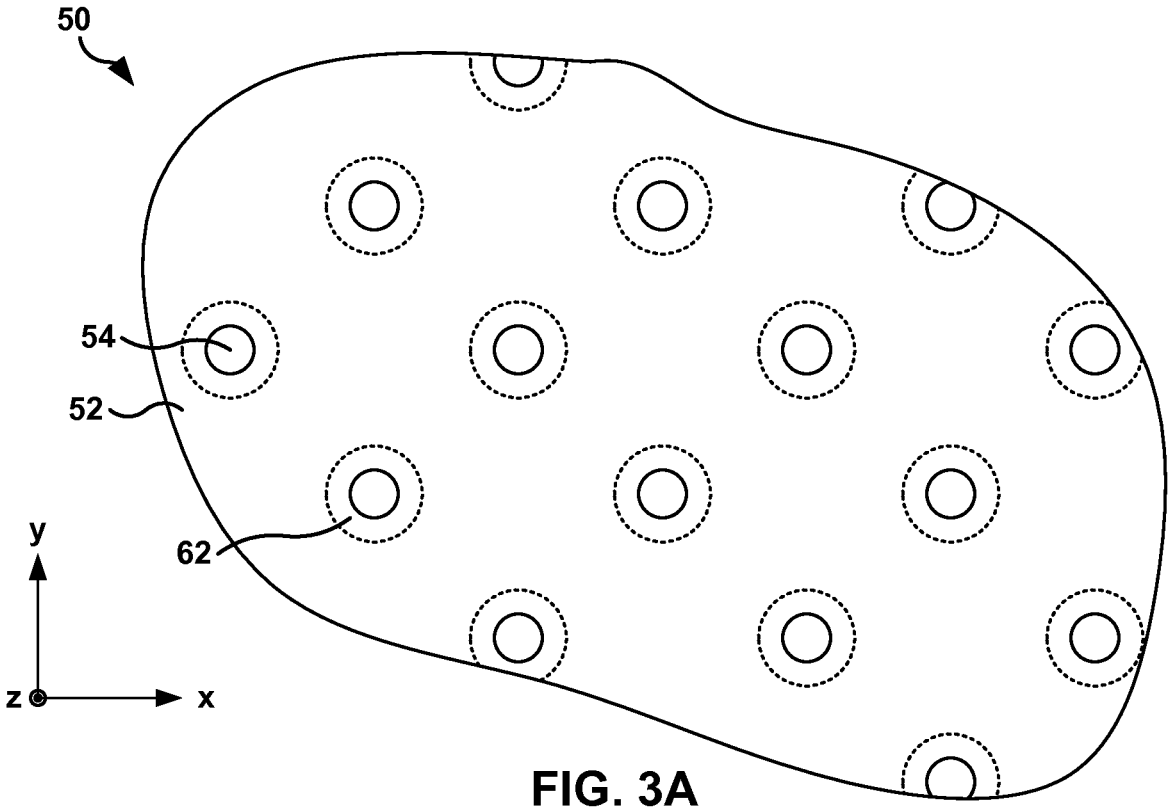
FIGS. 3A-3C are conceptual and schematic diagrams illustrating an example substrate including a plurality of cooling holes, which are partially covered by a coating.
Figure 3B:
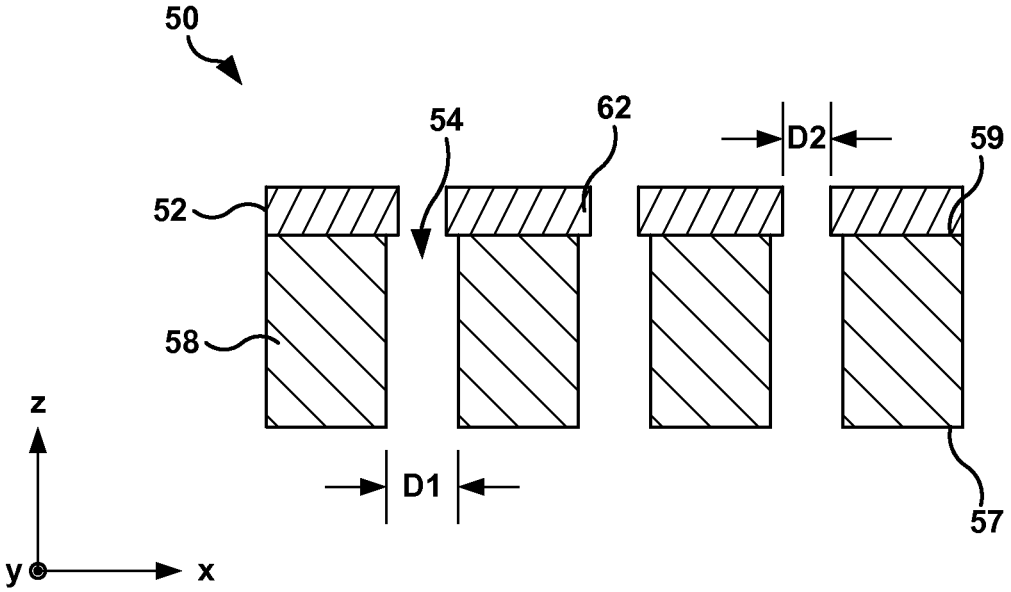
Figure 3C:
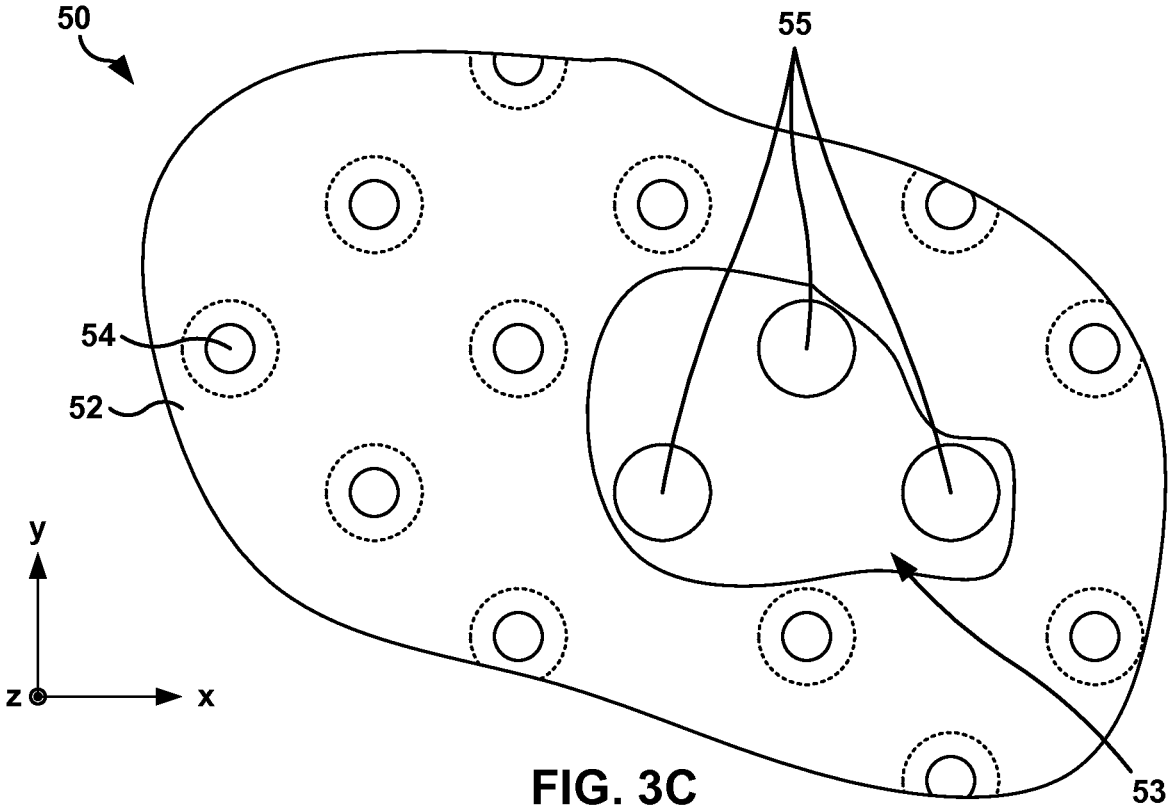

In some examples, instead of including some cooling holes that are substantially fully blocked or occluded by a coating, an article may include a plurality of cooling holes that are partially blocked or occluded by a coating. FIGS. 3A-3C are conceptual and schematic diagrams illustrating an example article 50 including a plurality of cooling holes 54, each of which is partially covered by a coating 52. Article 50 of FIGS. 3A-3C may be similar to or substantially the same as article 40 of FIGS. 2A-2C, aside from the differences described herein. For example, substrate 58 may include a superalloy, a ceramic, a CMC, or a silicon-containing alloy. As another example, coating 52 may include a TBC, an EBC, or both.

Article 50 includes a plurality of cooling holes 54. In contrast to article 40, article 50 includes a coating 52 that partially covers each of cooling holes 54. Although each of cooling holes 54 is partially occluded by coating 52 in the example illustrated in FIGS. 3A-3C, in other examples, only some of cooling holes 54 may be partially covered or occluded, while some of cooling holes 54 may be left completely uncovered, some of cooling holes 54 may be completely covered, or some of cooling holes 54 may be left completely uncovered and some of cooling holes 54 may be completely covered.

As seen in FIG. 3B, cooling holes 54 define a diameter, measured in the x-y plane, of D1. In some examples, D1 may be substantially the same (e.g., the same or nearly the same) for at least some of cooling holes 54 (e.g., D1 may be substantially the same for all of cooling holes 54). In other examples, D1 for at least one of cooling holes 54 may be different than D1 for at least one other of cooling holes 54.

Additionally or alternatively, although cooling holes 54 are illustrated as extending substantially normal to outer surface 59 of substrate 58, in some examples, at least some of cooling holes 54 may extend at an oblique angle with respect to outer surface 59. Cooling holes 54 may be arrayed throughout substrate in one or more predetermined patterns, as described above with respect to cooling holes 44 and 46 of FIGS. 2A-2C.

Above at least some of cooling holes 54 (e.g., each cooling hole 54 in FIGS. 3A-3C), coating 52 defines an aperture with a diameter of D2. In some examples, D2 may be substantially the same (e.g., the same or nearly the same) for at least some of cooling holes 54 (e.g., D2 may be substantially the same at all of cooling holes 54). In other examples, D2 at one of cooling holes 54 may be different at least some of cooling holes 54.

Diameter D2 defined by coating 52 is less than diameter D1 of cooling holes 54. The smaller diameter D2 if formed by coating by respective overhangs 62 of coating 52 over respective cooling holes 54. Overhangs 62 partially occlude cooling holes 54, such that flow of cooling fluid through the apertures defined by coating 52 is restricted, which reduces flow of cooling fluid through cooling holes 54 (e.g., compared to a cooling hole 54 that does not include a coating partially occluding the cooling hole 54). In this way, when coating 52 is intact adjacent to a respective cooling hole 54, coating 52 limits flow of cooling fluid through the respective cooling hole 54.

However, as shown in FIG. 3C, if a portion 53 of coating is damaged, a corresponding portion of substrate 58 may be exposed. The cooling holes 55 that were previously partially occluded when portion 53 was intact may be fully uncovered when the portion 53 spalls. These cooling holes 55 then may allow a greater amount of cooling fluid to flow from the internal cavities of article 50 (e.g., internal cavities 24 illustrated in FIG. 1B) through the cooling holes 55 and over the exposed portion of substrate 58 that was previously covered by coating 52, compared to when portion 53 of coating 52 was intact. This may result in desirable cooling of the portion of substrate 58 exposed when portion 53 of coating 52 spalls.

Although the additional cooling fluid flowing through fully exposed cooling holes 55 and over substrate 58 may reduce efficiency of the gas turbine engine, the additional cooling may reduce or substantially prevent further damage to the article 50 (including substrate 58) until the coating 52 can be repaired. In this way, article 50, including coating 52 and cooling holes 54 may include a damage tolerant cooling mechanism.

Figure 4:
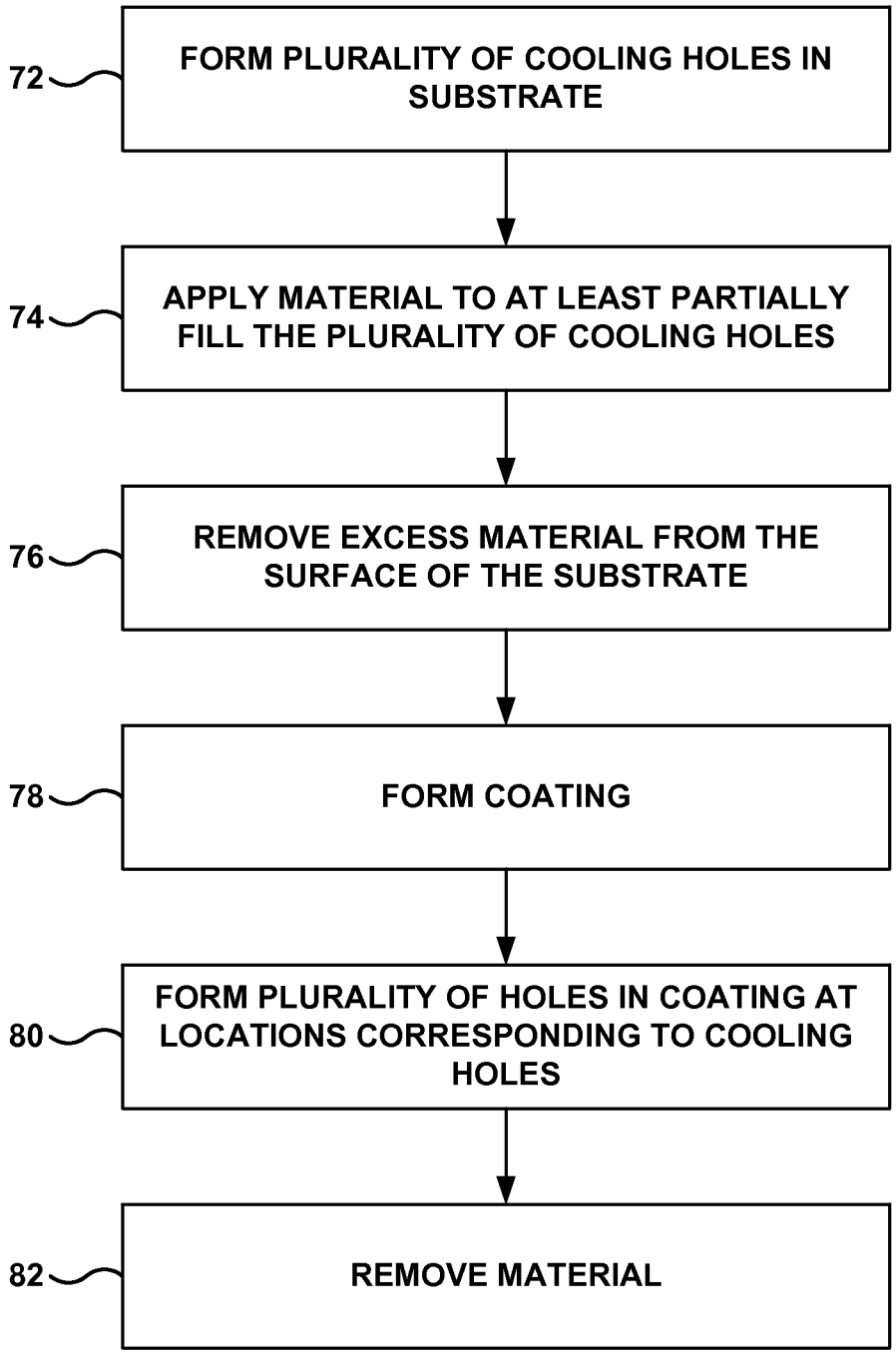
FIG. 4 is a flowchart illustrating an example technique for forming an article including a damage tolerant mechanism.

FIG. 4 is a flowchart illustrating an example technique for forming an article including a damage tolerant cooling mechanism, such as article 40 of FIGS. 3A-3C. The technique of FIG. 4 will be described with concurrent reference to FIGS. 5A-5F. FIGS. 5A-5F are conceptual and schematic diagrams illustrating example steps of the technique of FIG. 4 for forming an article including a substrate that includes a plurality of cooling holes, which are partially covered by a coating. Although the technique of FIG. 4 is described with reference to FIGS. 5A-5F, in other examples, the technique of FIG. 4 may be used to form other articles, and the article illustrated in FIGS. 5A-5F may be formed using other techniques.

Figure 5A:
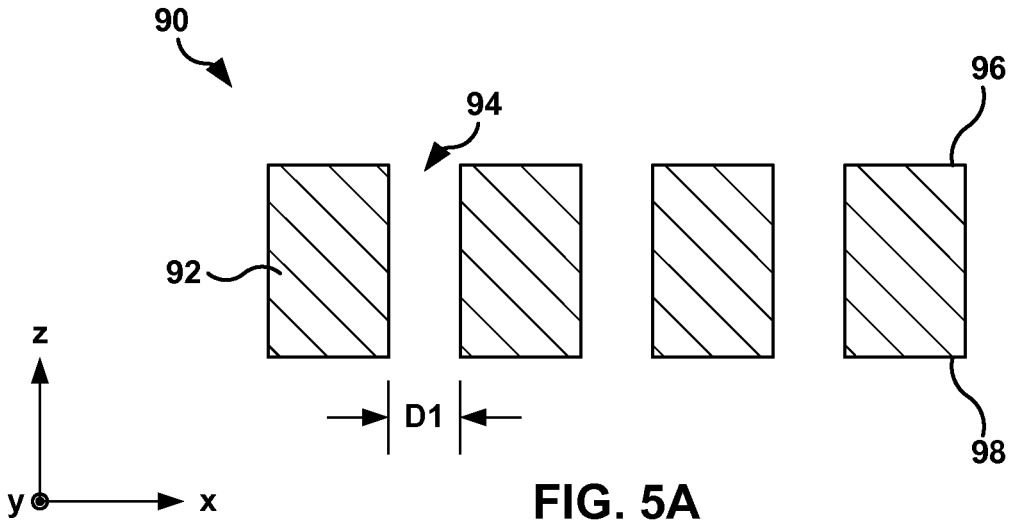
FIGS. 5A-5F are conceptual and schematic diagrams illustrating example steps of the technique of FIG. 4 for forming an article including a substrate that includes a plurality of cooling holes, which are partially covered by a coating.

The technique of FIG. 4 includes forming a plurality of cooling holes 94 in a substrate 92 (72). Cooling holes 94 define a diameter, measured in the x-y plane (where orthogonal x-y-z axes are shown in FIG. 5A for each of description), of D1. In some examples, each of cooling holes 94 may define the same diameter D1. In other examples, at least one of cooling holes 94 may define a different diameter than at least one other of cooling holes 94. As described above, although cooling holes 94 are illustrated as extending substantially orthogonal to outer surface 96 of substrate 92, in other examples, at least some of cooling holes 94 may extend at an oblique angle to outer surface 96.

Cooling holes 94 extend from outer surface 96 of substrate 92 to inner surface 98 of substrate 92. Although not shown in FIGS. 5A-5F, inner surface 98 of substrate 92 may define at least one cooling channel through which cooling fluid flows during operation of article 90. Cooling holes 94 may be formed using any suitable technique, including, for example, electrochemical etching, machining (drilling), ablation, or the like.

The technique of FIG. 4 also includes applying a material 100 to at least partially fill the plurality of cooling holes 94 (74). Material 100 may substantially fully occlude or block cooling holes 94 at outer surface 96 of substrate 92. In some examples, material 100 may include a polymeric material, such as a UV curable polymer. For example, material 100 may include a curable adhesive available from DYMAX® Corporation, Torrington, Conn. In examples in which material 100 includes a curable polymeric material, the curable polymeric material then may be cured (e.g., by heating article 90 and the curable polymeric material or by exposing the curable polymeric material to a suitable chemical or radiation).

Figure 5B:
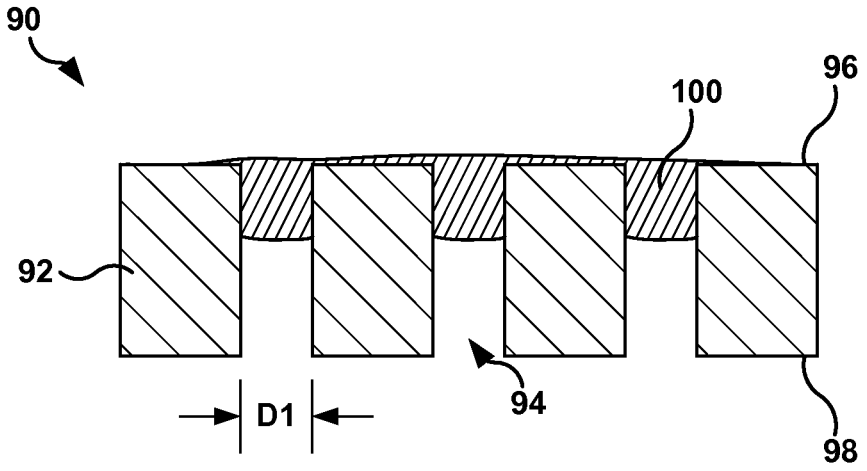
Figure 5C:
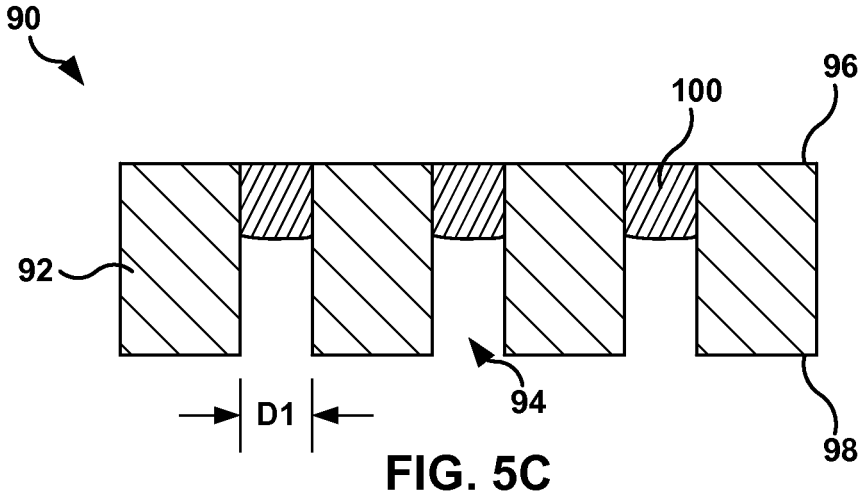

The technique of FIG. 4 further may include removing excess material 100 from outer surface 96 of substrate 92 (76). As shown in FIG. 5B, in some examples, excess material 100 may be present such that portions of outer surface 96 are covered with material 100. As coating 102 is to be deposited on outer surface 96, and the presence of material 100 may reduce adherence of coating 102 to outer surface 96, material 100 on outer surface 96 may be removed to leave outer surface 96 substantially uncovered, as shown in FIG. 5C. In some examples, a mechanical operation, such as grinding or polishing, may be used to remove material 100 from outer surface 96 while leaving material 100 in cooling holes 94.

Figure 5D:
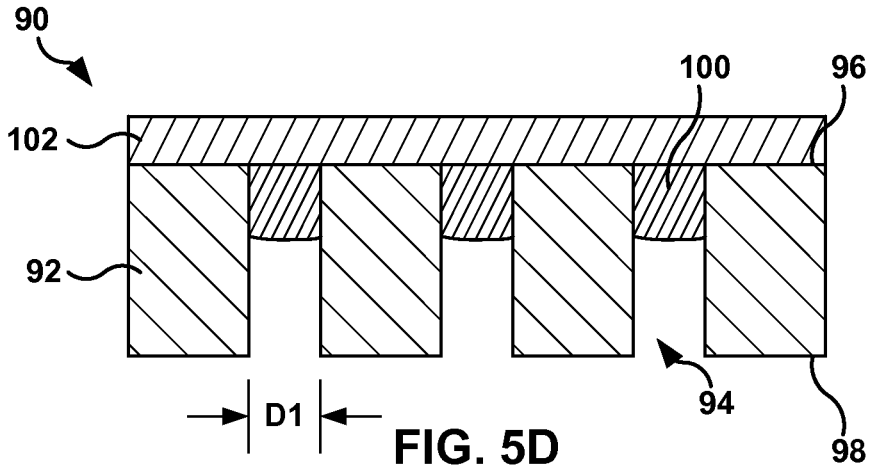

The technique of FIG. 4 also may include forming coating 102 on outer surface 96 of substrate 92 (78), as shown in FIG. 5D. As described above, coating 102 may include at least one of an EBC or a TBC. In some examples, coating 102 may include multiple layers, such as an EBC layer and a TBC layer. Coating 102 also may include other optional layers, such as a bond layer. In some examples, at least one layer of coating 102 (or coating 102 in cases in which coating 102 includes a single layer) may be deposited using a thermal spraying technique, such a plasma spraying.

Figure 5E:
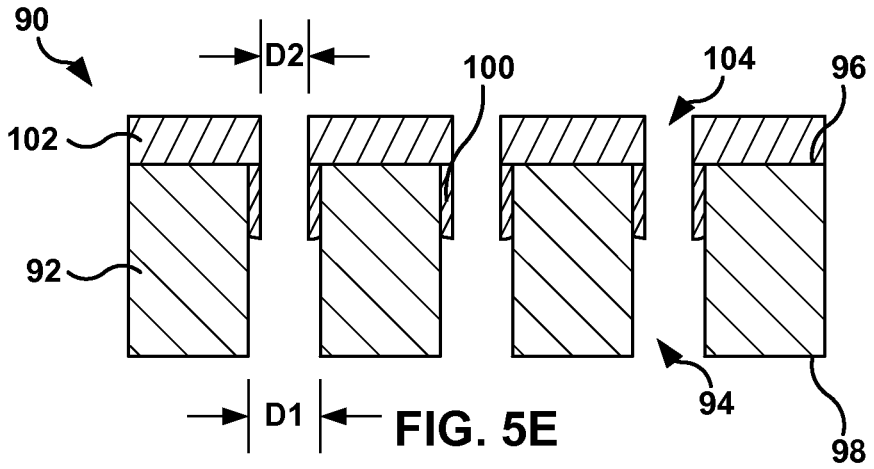

As shown in FIG. 5E, because coating 102 is formed on material 100 disposed in cooling holes 94, in some examples, coating 102 may not extend into the volume defined by cooling holes 94. In some examples, this may facilitate increase of the flow rate of cooling air through cooling holes 94 if coating 102 is damaged and detaches from surface 96. In contrast, if coating 102 extends into the volume defined by cooling holes 94, the portion of coating 102 disposed in the volume of a cooling hole 94 may not separate from substrate 92 when the an adjacent portion of coating 102 on outer surface 96 is damaged. This may reduce or substantially eliminate the increase in cooling air flowing through the cooling hole 94, which may result in a smaller increase in cooling capacity if the portion of coating 102 is damaged.

Once coating 102 is formed on outer surface 96 (78), the technique includes forming a plurality of holes or apertures in coating 102 at respective locations corresponding to respective ones of cooling holes 94 (80). The plurality of holes or apertures 104 may be formed by ablation (e.g., laser ablation), drilling, or the like. As shown in FIG. 5E, apertures 204 may define a diameter D2, measured parallel to outer surface 96 of substrate 92. In some examples, as shown in FIG. 5E, diameter D2 may be smaller than diameter D1 of cooling holes 94. In other examples, diameter D2 may be substantially the same as D1.

Although FIG. 5E illustrates a respective aperture 104 formed at a location corresponding to each respective cooling hole 94, in some examples, at least some of cooling holes 94 may not have a corresponding aperture 104 formed in coating 102. Instead, in some examples, at least some of cooling holes 94 may be left substantially fully occluded, as illustrated in FIGS. 2A-2C. Any combination of cooling holes 94 being substantially fully occluded by coating 102, partially occluded by coating 102, or being substantially fully uncovered by coating 102 may be included in a single article 90.

Figure 5F:
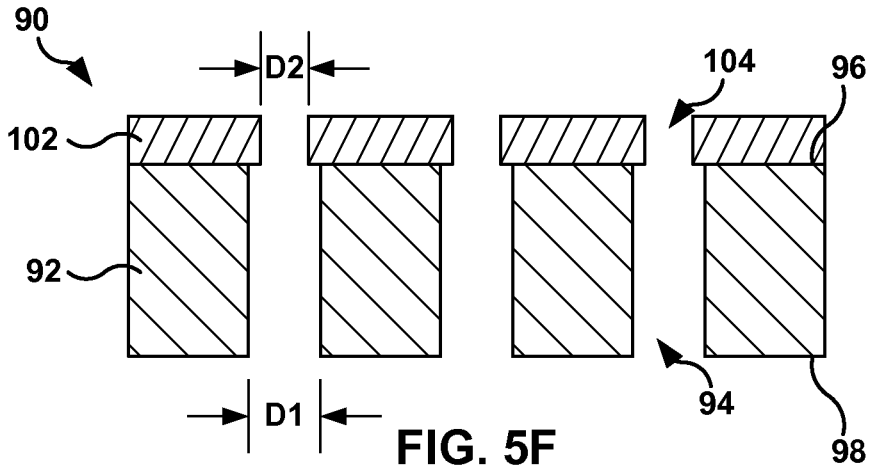

In some examples, the technique of FIG. 4 further includes removing material by heating article 90 above a melting or burning temperature of material 100 (82). This may remove substantially all of material 100 from the volume defined by cooling holes 94, as shown in FIG. 5F. In some examples, rather than heating article 90 above a melting or burning temperature of material 100 (82) as part of the technique of FIG. 4, the initial heating cycles of article 90 during service may heat material 100 sufficiently to remove material 100 from cooling holes 94.

Various examples have been described. These and other examples are within the scope of the following claims.

The invention claimed is:

1. A method comprising:

forming a plurality of cooling holes in a substrate, wherein each cooling hole of the plurality of cooling holes defines a diameter D1 measured parallel to a surface of the substrate;

applying a material to occlude the plurality of cooling holes while leaving the surface of the substrate substantially uncovered;

forming an oxide-based thermal barrier or oxide-based environmental barrier coating on the surface of the substrate and a surface of the material; and forming a respective aperture in the oxide-based thermal barrier or oxide-based environmental barrier coating at each of a plurality of respective locations corresponding to respective locations of the plurality of cooling holes such that the oxide-based thermal barrier or oxide-based environmental barrier coating covers and partially occludes each cooling hole of the plurality of cooling holes, wherein each aperture of the plurality of apertures defines a diameter D2 above the respective cooling hole, wherein the diameter D2 is measured parallel to the outer surface of the substrate, and wherein D2 of the respective aperture in the oxide-based thermal barrier or oxide-based environmental barrier coating is smaller than D1 of the respective cooling hole; and after forming the respective aperture in the oxide-based thermal barrier or oxide-based environmental barrier coating at each of the plurality of respective locations corresponding to respective locations of the plurality of cooling holes, heating the substrate and the oxide-based thermal barrier or oxide-based environmental barrier coating to remove remaining material from the plurality of cooling holes.

2. The method of claim 1, wherein applying the material to occlude the plurality of cooling holes while leaving the surface of the substrate substantially uncovered comprises:

applying the material to occlude the plurality of cooling holes, wherein the material at least partially covers the surface of the substrate; and removing the material from the surface of the substrate to leave the surface of the substrate substantially uncovered.

3. The method of claim 1, wherein the material comprises a curable polymer.

4. The method of claim 1, wherein forming the oxide-based thermal barrier or oxide-based environmental barrier coating on the surface comprises plasma spraying the oxide-based thermal barrier or oxide-based environmental barrier coating on the surface of the substrate.

5. The method of claim 1, wherein forming the respective aperture in the oxide-based thermal barrier or oxide-based environmental barrier coating at each of the plurality of respective locations corresponding to respective locations of the plurality of cooling holes comprises drilling the respective aperture in the oxide-based thermal barrier or oxide-based environmental barrier coating at each of the plurality of respective locations corresponding to respective locations of the plurality of cooling holes.

6. The method of claim 1, wherein:

the plurality of cooling holes comprises a first plurality of cooling holes;

the method further comprises:

forming a second plurality of cooling holes in the substrate, wherein the second plurality of cooling holes are interleaved with the first plurality of cooling holes;

applying the material to occlude the plurality of cooling holes while leaving the surface of the substrate substantially uncovered comprises applying the material to occlude the first plurality of cooling holes and the second plurality of cooling holes while leaving the surface of the substrate substantially uncovered;

forming the respective aperture in the oxide-based thermal barrier or oxide-based environmental barrier coating at each of the plurality of respective locations corresponding to respective locations of the plurality of cooling holes comprises forming the respective aperture in the oxide-based thermal barrier or oxide-based environmental barrier coating at each of the plurality of respective locations corresponding to respective locations of the first plurality of cooling holes such that the oxide-based thermal barrier or oxide-based environmental barrier coating covers and partially occludes each cooling hole of the first plurality of cooling holes; and apertures are not formed in the oxide-based thermal barrier or oxide-based environmental barrier coating at locations corresponding to respective locations of the second plurality of cooling holes.

* * * * *